United States Patent [19]

Gebhardt et al.

[11] 3,985,627

[45] Oct. 12, 1976

[54] DEVICE FOR MAGNETIC LIFTING AND REMOVAL OF THE FEED OPENING COVER OF A COKING CHAMBER OVEN

[75] Inventors: Günter Gebhardt, Dortmund; Josef Peters, Bochum, both of Germany

[73] Assignee: Klockner-Humboldt-Deutz Aktiengesellschaft, Germany

[22] Filed: Apr. 12, 1974

[21] Appl. No.: 460,464

[30] Foreign Application Priority Data

Apr. 12, 1973 Germany ..... 2318345

[52] U.S. Cl. ..... 202/262; 202/248; 212/4

[51] Int. Cl.[2] ..... C10B 35/00; C10B 25/24

[58] Field of Search ..... 202/262, 247, 248, 242, 202/245, 270; 214/18 PH; 212/4, 48

[56] References Cited

UNITED STATES PATENTS

| | | | |
|---|---|---|---|
| 3,440,145 | 4/1969 | Tucker et al. | 202/262 |
| 3,536,205 | 10/1970 | Bender | 202/262 |
| 3,642,148 | 2/1972 | Durand | 212/48 |
| 3,709,387 | 1/1973 | Kinzler et al. | 202/262 |
| 3,753,502 | 8/1973 | Abendroth | 214/18 PH |
| 3,774,787 | 11/1973 | Ledinsky | 202/262 |
| 3,805,975 | 4/1974 | Feldhaus | 202/262 |

*Primary Examiner*—Norman Yudkoff
*Assistant Examiner*—Dale Lovercheck
*Attorney, Agent, or Firm*—Hill, Gross, Simpson, Van Santen, Steadman, Chiara & Simpson

[57] ABSTRACT

A device for magnetic lifting and removal of the feed opening cover of a coking chamber oven from the charging region of said oven comprises a magnet carried by a gripping unit and operatively connected with a crank drive for rotating said cover back and forth in said gripping unit, said magnet further being operatively connected with a displaceable slide means through the intermediary of a guide rail for guiding the movement of the slide means, the rail having horizontal and vertical branches, actuation of a drive means for said slide means first causes lifting of said cover and then lateral displacement of said slide means with said cover.

6 Claims, 6 Drawing Figures

Figure 1:
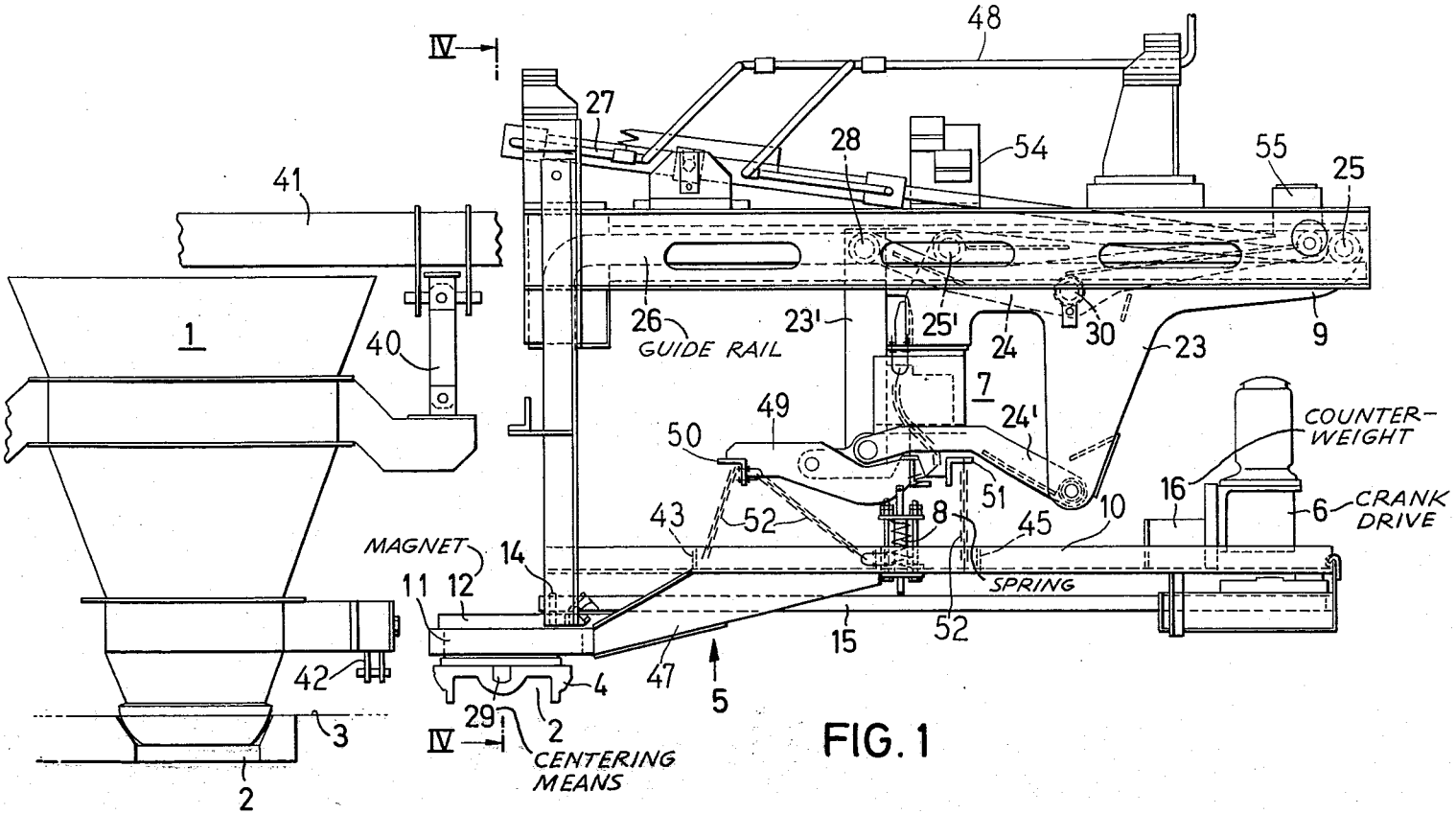

DEVICE FOR MAGNETIC LIFTING AND REMOVAL OF THE FEED OPENING COVER OF A COKING CHAMBER OVEN

This invention relates to a device for magnetic lifting of the feed opening cover of coking chamber ovens and for removal of said cover from the filling or feeding region by means of a gripping unit with magnet.

From the published German patent application No. 1,807,432 a device is known for magnetic lifting of the feed opening cover of coking chamber ovens. In this device the feed opening cover is removed from the feeding region by means of a substantially vertically arranged rod which on its lower bent end portion carries the lifting magnet and at its upper end is connected with a drive means through the intermediary of a lever. Said rod is so bent and so guided by means of a roller guide arrangement associated with the charge carriage that actuation of the drive means causes the rod first to perform an upwardly movement and then a swinging movement in a vertical plane. Thanks to these structural features it is claimed that only one driving device is required for the raising of the feed opening cover and the removal of the same from the charging area.

It has, however, been discovered in actual practice that prior to the lifting and removal of the feed opening cover by means of the removal device a rotation of the cover is necessary in order to free it from coal dust deposits and thus avoid overloading of the lifting device. In known structures an additional driving device has therefore been provided on the lifting magnet, with the aid of which the feed opening cover is rotated free before being removed. However, such constructions have the disadvantage of requiring a considerable structural height between the oven roof and the filling or feeding elements.

It is the object of the present invention to improve the known constructions of cover removal means for coking chamber ovens in such a way that the feed opening cover prior to its raising and removal from the region of the feeding members is additionally turned free while in spite hereof enabling the height of the feeding elements above the oven roof to be maintained at a minimum.

According to the invention this object is achieved by connecting the magnet of the gripping device with a crank drive for rotating the feed opening cover back and forth and with a reciprocating slide which is driven through the intermediary of at least one linkage means that is coupled to the slide driving means in such a manner as first to effect the raising of the feed opening cover and then the removal movement of the slide. Hereby it is advantageously achieved that the feed opening cover in a single operation is first rotated and then lifted and removed from the region of the feed opening, while the distance between the feed member of the charge carriage and the oven roof need only correspond to the structural height of the cover and magnet. For this reason the inventive device is advantageously suitable particularly for subsequent incorporation with charge carriages having only a small height between oven roof and filling member, whereby optimum adaptation to prevailing space conditions is feasible.

Another advantage of the structural features according to the invention is that the linkage means can be kinematically designed in such a manner as to render feasible a positively controlled vertical movement upwardly of the feed opening cover. Hereby it is avoided that the heavy cover due to inaccurate guidance in its upwardly movement damages the cover seat in the feed opening in a manner to cause considerable uncontrolled emission of the gases produced in the coking process.

In the development of the invention it is provided that the gripping unit is arranged for lateral movement. This constructional feature provides a simple and economical structure which allows for accurate guidance and optimum adaptation to space conditions between oven roof and filling means.

According to a further feature of the invention it is provided that the magnet of the gripping means is rotatably mounted in a holder. Hereby the turning of the feed opening cover back and forth is made feasible in a particularly simple manner. It is preferable that the feed opening cover and/or the magnet of the gripping unit be provided with a centering means which makes for simple adjustment of the gripping unit magnet on the feed opening cover.

In a preferred embodiment of the invention it is provided that the gripping unit in the region of its center of gravity is connected with the linkage means and the reciprocatory slide by means of a spring, whereby in an advantageous manner damage to the cover seat through hard impacts is avoided in case of rapid lowering of the cover onto the feed opening in the oven roof should become necessary. Furthermore, it is in a simple way feasible through the intermediary of the spring to provide optical or acoustic indication by means of an additional control device as to whether the feed opening cover has been seized by the gripping unit.

In a further development of the invention counterweights for regulating the center of gravity are provided on the gripping unit, preferably in a slidable manner. The advantage of such an arrangement is that the location of the center of gravity of the lifting device can in an optimal way be maintained even when the cover has been seized by the gripping unit. Furthermore, the springs which in known devices are necessary for load equalization, and which are subjected to heavy wear, can be omitted and thereby the danger of material fatigue is largely eliminated.

Figure 2:
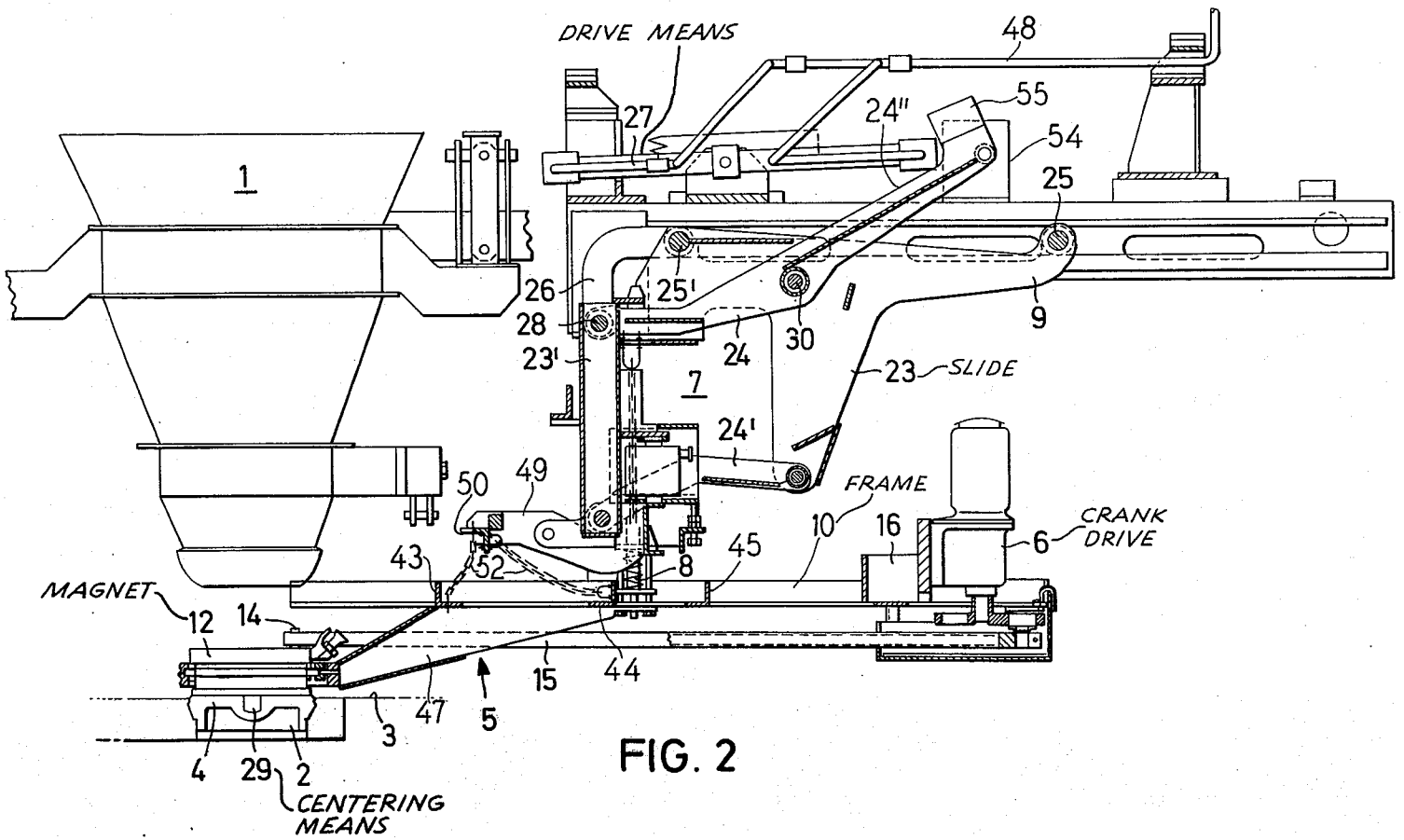
Figure 3:
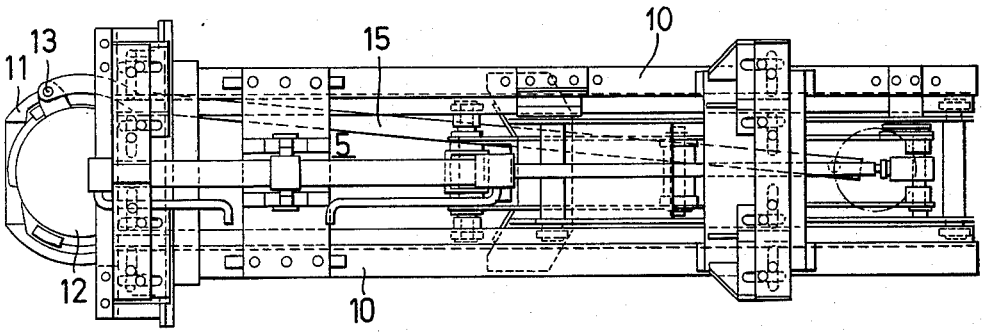
Figure 4:
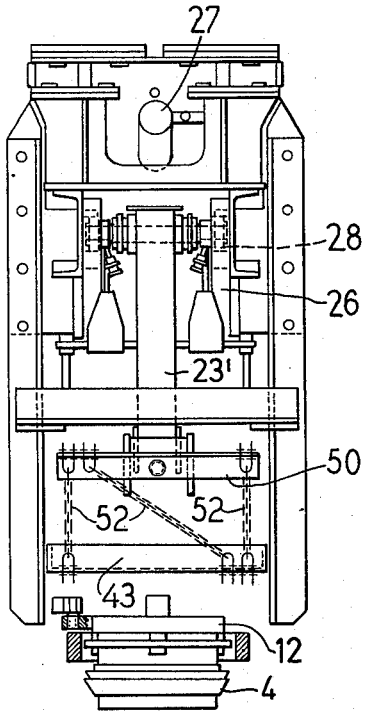
Figure 5:
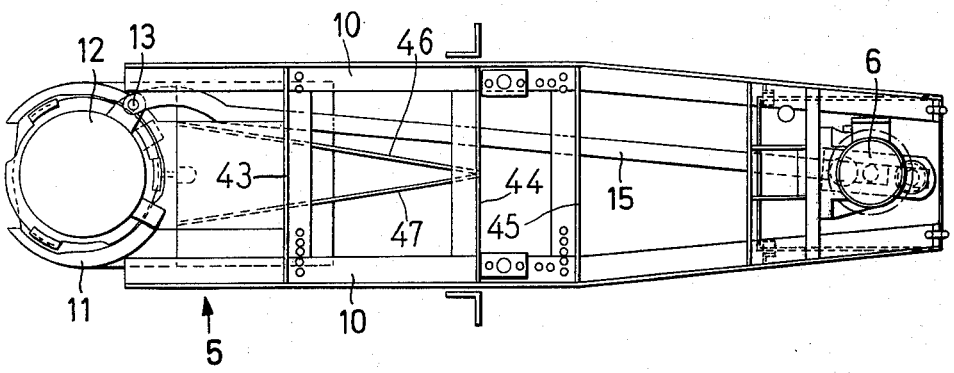
Figure 6:
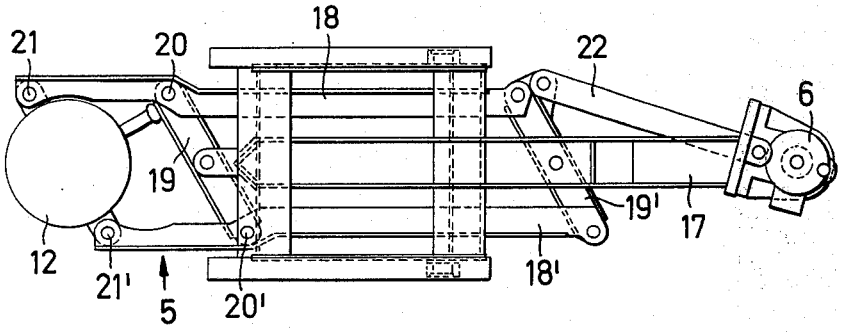

Additional details, features and advantages of the invention are explained below with reference to the accompanying diagrammatical drawings, in which FIGS. 1 and 2 show in side elevation an embodiment of the invention in two operational stages, FIG. 3 shows a top view, FIG. 4 shows a section along line IV—IV in FIG. 1, and FIGS. 5 and 6 show preferred embodiments of the gripping unit with magnet.

In FIGS. 1 and 2 a filling or feed member 1 is associated with the feed opening 2 in the oven roof 3, said feed member being supported by means of straps 40 on a member 41 of a charge carriage (not shown) which is movable on the oven roof. At the lower end of said feed member a shut-off gate (not shown) with actuator means 42 is provided for control of the delivery of the coal to be coked. For feeding the coal into the oven chamber said feed member may be lowered from the charge carriage onto the feed opening 2 in the oven roof 3 by manipulation of the support straps 40.

In the feed opening 2 a feed opening cover 4 is insertible which prior to the lowering of the feed member and the subsequent charging of the oven chamber must be removed. For this purpose a cover removing device is provided which according to the invention comprises several structural units, viz.

a. a gripping member 5 with magnet 12 which is associated with a crank drive 6 for rotating the cover back and forth, b. linkage means 7 comprising two parallel linkages and on which the gripping unit 5 with the magnet 12 is suspended by means of a spring 8, and c. a movable slide member 9 which is connected with the linkage means in such a way that the gripping unit 5 first raises the feed opening cover 4 and then moves the same out from the region of the feed member 1. The cover removal device is secured to the support structure for the coke oven charge carriage.

In the position of the cover removal device shown in FIG. 1 the feed member 1 with its transfer funnel is lowered onto the feed opening 2 in the oven roof 3, so that the coal to be coked can be discharged into the coking chamber oven. During this charging stage the feed opening cover 4 is in operational connection with the magnet 12 of the gripping unit 5 and is disposed outside of the region of the feed member 1 and above the oven roof 3. In FIG. 2 the feed member 1 is raised from the feed opening 2 with the shut-off gate closed and the cover 4 is shown in position on the feed opening 2.

In FIG. 5 the gripping unit 5 is shown as comprising side frame members 10 and interconnecting transverse frame members 43, 44, 45. At one end of the frame a holder 11 is mounted in which a magnet 12 is rotatably disposed. The holder 11 is connected with the gripping unit frame by a pair of plate members 46, 47 depending from the frame. The magnet 12 is at its periphery provided with a bearing bushing 13 in which the bearing pin 14 of a connecting rod 15 engages, said connecting rod 15 being connected with the crank drive 6 for rotary movement of the magnet 12 with the feed opening cover back and forth. The crank drive 6 is disposed at the opposite end of the unit 5 from the holder. On said unit 5 there are additionally provided counterweights 16 for regulation of the center of gravity thereof, said counterweights preferably being slidable, so that the position of the center of gravity of the gripping unit can be maintained also when the magnet 12 is in operative connection with the feed opening cover 4. For the purpose of accurate adjustment of the cover 4 with the magnet 12 either said cover 4 or said magnet 12 is provided with a centering means 29.

FIG. 6 shows another preferred embodiment of the gripping unit. In this embodiment the gripping unit is provided with a carrier arm 17 on which a linkage means is arranged which comprises two parallel linkage arms 18, 18' and two linkage levers 19, 19' which latter are centrally and rotatably secured to the carrier arm 17. At one end of the four-sided linkage means the linkage arms 18, 18' are extended beyond the linkage pivots 20, 20' and carry at its ends the magnet 12 in bearings 21, 21'. At the opposite end of the carrier arm 17 from the magnet the crank drive 6 for turning the cover 4 back and forth is disposed which through the intermediary of a coupling rod 22 is connected with the linkage lever 18.

According to FIGS. 1 and 2 the slide member 9 is by means of support rollers 25, 25' displaceably retained in a guide rail 26 which is secured to the support structure for the coke oven charge carriage (not shown). With the slide member 9 the linkage means 7 is connected which is constituted by linkage arms 23, 23' and linkage levers 24,24', only the linkage arm 23 being rigidly secured to the displaceable slide member. On the linkage arm 23' the gripping unit 5 is supported in the region of its center of gravity by means of an equalization spring 8. The linkage lever 24 of the linkage means 7 extends beyond the linkage pivot 30 and is bent beyond this point and connected with a drive means 27, preferably a hydraulic device including a pipe system 48, in such a manner that said drive means through the intermediary of the linkage means of the gripping unit with the magnet first raises the feed opening cover 4 and then moves the slide member 9 along the guide rail 26. For this purpose the pivot connection between the linkage arm 23' and the linkage lever 24 is made in the form of a support roller 28 which is positively guided along the guide rail 26.

The linkage members 23', 24' are connected with a secondary lever 49 with transverse angle iron members 50, 51 connected with the gripping unit 5 by means of chains 52. The lever 24 is provided with an arm 24'' for cooperation with the drive means 27 and magnetic coupling means 54, 55 for the raising and lowering of the gripping unit 5, as indicated in FIGS. 1 and 2.

The inventive arrangement of the device for magnetic lifting of the feed opening cover from the coking chamber oven is not limited to the described embodiments but, on the contrary, it is advantageously feasible within the framework of the invention to provide a device by means of which the feed opening cover is first freed by rotation, then raised and finally moved laterally out of the charging or filling region.

We claim as our invention:

1. A device for magnetic lifting and removal of the feed opening cover of a coking chamber oven from the feed opening region of said oven, comprising a magnet, a gripping unit rotatably supporting said magnet, a crank drive, means connecting said crank drive mechanism with said magnet for rotary movement of said magnet in relation to said gripping unit, a lower horizontal transverse frame member carrying the magnet and gripping unit at one end and carrying said crank drive at the opposite end with said connecting means carried on the frame member and extending between the drive and the magnet, a slide means supporting the transverse frame member intermediate its ends, a guide rail for said slide means and transverse frame member guiding the movement of the slide means and transverse frame member in a vertical plane extending through the cover, said guide rail including a vertical branch and a horizontal branch extending laterally away from the feed opening of the oven, the branches of the guide rail being continuous with each other, and drive means for said slide means, said vertical branch first limiting lifting movement of said transverse frame and magnet vertically, said horizontal branch limiting movement of said transverse frame and magnet horizontally from the region of said feed opening all in said vertical plane, said vertical branch preventing horizontal movement of said slide means in a horizontal direction until the frame is in its fully raised position.

2. A device according to claim 1, in which said magnet of the gripping unit is rotatably mounted in a holder.

3. A device according to claim 1, in which the feed opening cover and the magnet of the gripping unit are provided with coacting centering means.

4. A device according to claim 1, in which the transverse frame is connected in the region of its center of gravity with the slide means by means of a spring.

5. A device according to claim 1, in which on said transverse frame slidable counterweights are provided for regulating the center of gravity of the frame with and without said feed opening cover attached thereto.

6. A device according to claim 1, in which said slide means includes a pair of pivotal arms extending substantially parallel to each other for stabilizing movement of the frame member.

* * * * *